United States Patent [19]

Wiggins

[11] Patent Number: 4,777,809

[45] Date of Patent: Oct. 18, 1988

[54] OUTBOARD MOTOR LOCK

[76] Inventor: Charles Wiggins, R.D. #4, Box 41, Tunkhannock, Pa. 18657

[21] Appl. No.: 101,779

[22] Filed: Sep. 28, 1987

[51] Int. Cl.[4] ..... E05B 65/00

[52] U.S. Cl. ..... 70/57; 70/58; 70/19; 70/212; 70/230; 70/232

[58] Field of Search ..... 70/14, 19, 54–56, 70/57, 58, 178, 207, 182–184, 209–212, 229–232; 411/87, 90, 99

[56] References Cited

U.S. PATENT DOCUMENTS

| | | | |
|---|---|---|---|
| 661,060 | 11/1900 | Lenhult | 411/99 |
| 2,279,006 | 4/1942 | McWalters | 70/19 |
| 2,478,339 | 8/1949 | Sullivan | 70/230 |
| 2,479,300 | 8/1949 | Binz | 70/232 |
| 2,984,096 | 5/1961 | Putman et al. | 70/58 X |
| 3,287,943 | 11/1966 | Vaughn et al. | 70/58 |
| 3,505,839 | 4/1970 | Pavek | 70/230 |
| 3,650,130 | 3/1972 | Thompson | 70/58 |
| 3,753,359 | 8/1973 | Frey | 70/19 |
| 3,808,851 | 5/1974 | Kargus et al. | 70/232 |
| 3,848,441 | 11/1974 | Quincey | 70/55 X |
| 3,943,738 | 3/1976 | Foote | 70/54 X |
| 4,557,458 | 12/1985 | Vahlberg et al. | 70/58 X |
| 4,562,707 | 1/1986 | Graham, III | 70/58 |

FOREIGN PATENT DOCUMENTS

| | | | |
|---|---|---|---|
| 1298376 | 6/1962 | France | 70/232 |
| 180819 | 11/1935 | Switzerland | 70/287 |

*Primary Examiner*—Gary L. Smith
*Assistant Examiner*—Suzanne L. Dino
*Attorney, Agent, or Firm*—Michael J. Delaney

[57] ABSTRACT

An anti-theft device for locking an outboard motor comprising an elongated, channel-like, body member has a longitudinally extending opening to closely receive the head portions of clamping screws which clamp the motor to a transom board of a boat, or a motor stand for use in motor sales and/or service. The body member includes a slot to receive the shanks of the screws while allowing the screws to pass through the body member while the head portions are confined within the body member. Stops within the longitudinal opening in the body member are shaped to fit within recesses or notches in the head portions of the clamping screws. Locking means including a padlock secure the head portions of the clamping screws tightly within the body member and in contact with the stops to prevent rotation of the clamping screws.

4 Claims, 2 Drawing Sheets

OUTBOARD MOTOR LOCK

BACKGROUND OF THE INVENTION

The present invention relates to locking devices for an outboard motor and, more specifically, to locking devices to prevent the theft of the motor by preventing the loosening of the clamping screws which secure the motor to the transom board of a boat or to a motor stand used in sales and/or service of motors.

Numerous prior art devices have been proposed to prevent the theft of an outboard motor. For the most part, such prior art devices have not been entirely satisfactory because in some cases the devices do not prevent the clamping screws which hold the motor in place from becoming loose by vibration. In other cases, the prior art devices do not prevent someone from gripping the shank or threads of the clamping screws with a tool, such as pliers, and loosening the screws. In addition, some of the prior art devices are not designed to remain in place while the motor is being operated. Additionally, some of the prior art devices are very complicated and costly to produce. Furthermore, some of the prior art devices are very limited in their application and require alterations and/or additions to the conventional outboard motor and its clamping arrangement.

SUMMARY OF THE INVENTION

It is an object of this invention to provide a locking device for an outboard motor which prevents the clamping screws from being turned while the locking device is in place.

It is another object of this invention to provide an anti-theft device for locking an outboard motor to a transom of a boat, which device may remain in place during operation of the motor without in any way interfering with the normal use of the motor.

It is another object of this invention to provide a simple and economical locking device for an outboard motor which device requires no alterations or additions to the outboard motor and its clamping arrangement.

The above objects are attained by this invention by providing an anti-theft device for locking an outboard motor to a transom board of a boat or to a motor stand including an elongated, channel-like, body member having a longitudinally extending opening closed at one end and open at the other end for closely receiving the head portions of the clamping screws which secure the motor in place. The body member has a slot in one of its sides to allow the shanks of the screws to pass through the body member while the head portions of the screws are confined within the body member. The head portions of the clamping screws have a plurality of recesses or notches formed therein. A first stop is located within the body member adjacent the closed end thereof, and shaped to fit within one of the recesses or notches of one of the head portions of the clamping screws. A second stop is positioned within the body member adjacent the open end thereof and also shaped to fit within one of the recesses or notches of another of said head portions. Locking means adjacent said open end includes a padlock having a removable shackle with prongs which pass through openings in the body member. The locking means secures the head portions of the clamping screws within the body member with the first and second stops positioned within the recesses in the head portions of the clamping screws to prevent rotation of the clamping screws.

BRIEF DESCRIPTION OF THE INVENTION

DETAILED DESCRIPTION OF THE INVENTION

Figure 1:
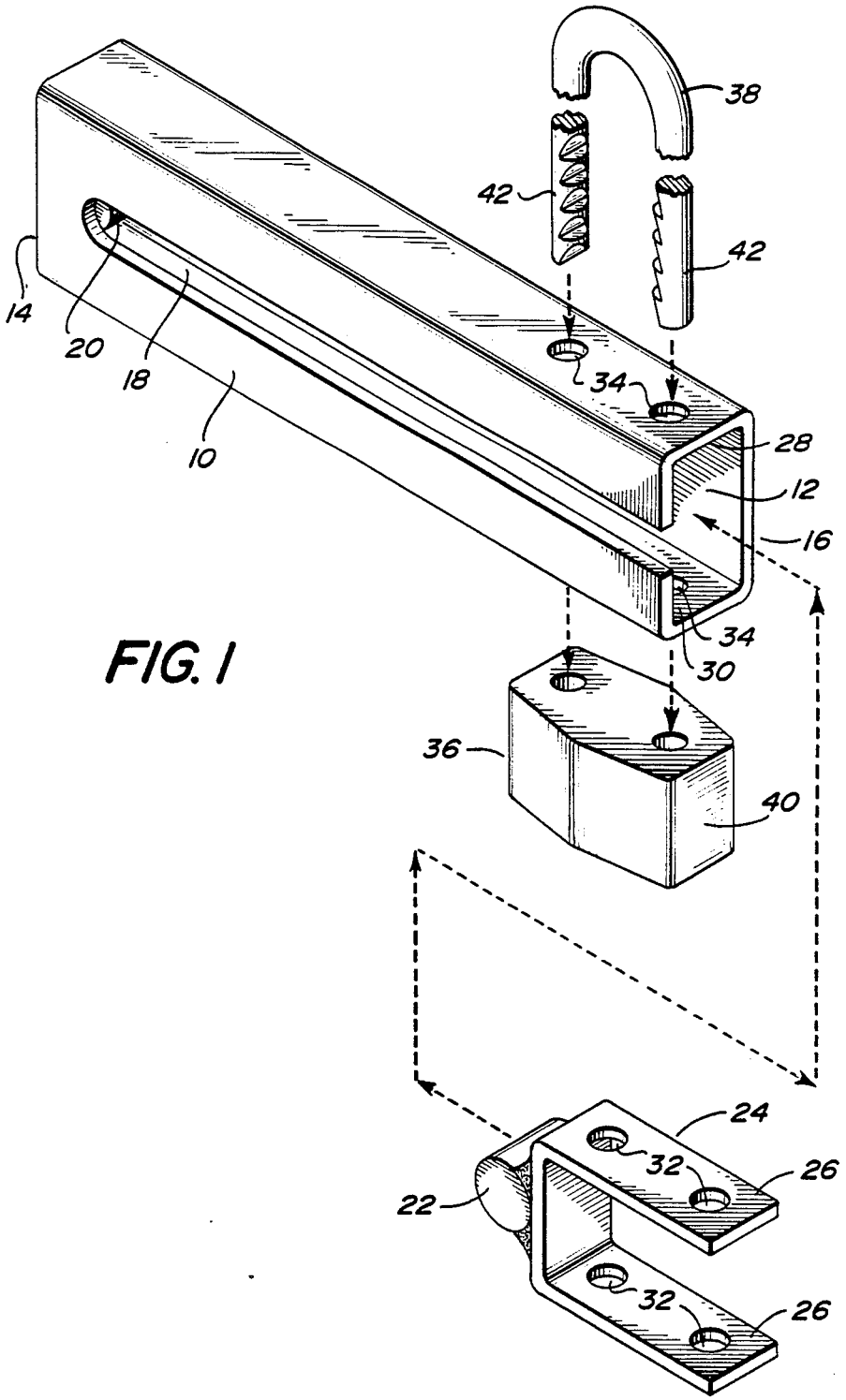
FIG. 1 is a perspective, assembly view of the invention.

Referring to FIG. 1, an elongated, channel-like, body member 10 is formed from a rectangular, steel channel section having a longitudinally extending opening 12. End 14 of the body member 10 is closed while end 16 of the body member 10 is open to allow entry into the body member 10. A slot 18 is provided in one side of the body member 10. The slot 18 extends from the open end 16 and stops short of the closed end 14. Located within the body member 10 adjacent the closed end 14 is a first stop 20. Adapted to be placed within the opening 12 in the body member 10 adjacent the open end 16 is a second stop 22. Second stop 22 is fixedly attached to a U-shaped member 24 having legs 26 which extend within the body member 10 adjacent the interior top 28 and bottom 30 walls of the body member 10. Each leg 26 has a pair of holes 32 which match with holes 34 in the top 28 and bottom 30 walls of the body member 10. Locking means 36 includes a padlock having a removable shackle 38 and a tumbler portion 40. The prongs 42 of removable shackle 38 pass through openings 34 in the top 28 and bottom 30 walls of the body member 10 and the openings 32 in the legs 26 of the U-shaped member 24.

Figure 2:
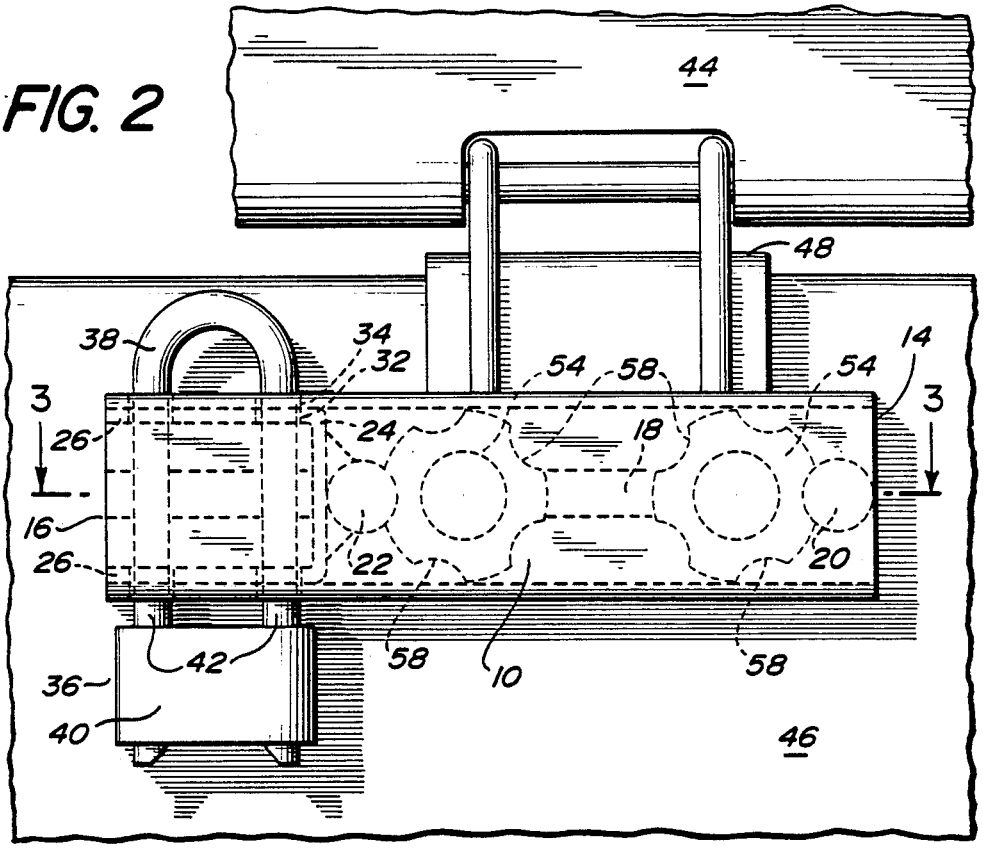
FIG. 2 is a side view of the invention.
Figure 3:
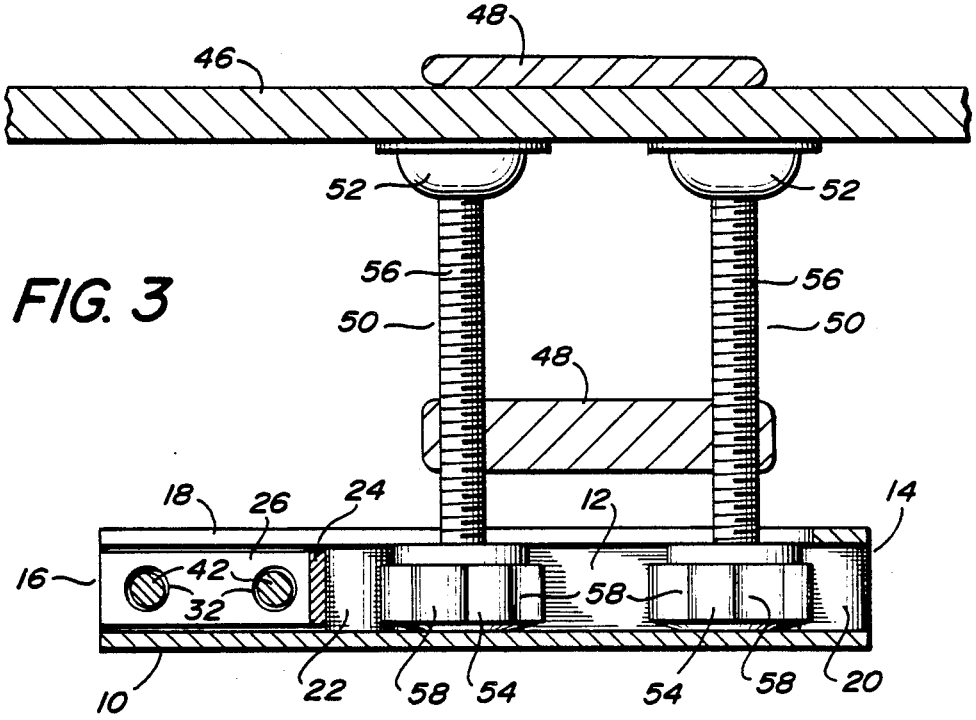
FIG. 3 is a view taken along the lines 3—3 of FIG. 2.

Referring to FIGS. 2 and 3, an outboard motor 44 is mounted on a transom 46 of a boat in the conventional manner by means of a C-shaped mounting bracket 48 through which is threaded a pair of clamping screws 50 having foot bearing pads 52 for engaging the transom board 46 of a boat. As best seen in FIG. 3. the clamping screws 50 have head portions 54, foot bearing pads 52 and threaded shanks 56. The head portions 54 of the clamping screws 50 have a plurality of recesses or notches 58 in their periphery. The first 20 and second 22 stops are shaped to fit within the recesses or notches 58 of the head portions 54 and prevent rotation of the clamping screws 50.

As best shown in FIG. 2, the head portions 54 of the clamping screws 50 fit closely within the opening 12 in the body member 10 and the shanks 56 of the clamping screws 50 pass through slot 18 in body member 10. The first stop 20 which is within the opening 12 and adjacent the closed end 14 fits within one of the recesses or notches 58 in the head portion 54 of one of the clamping screws 50. The second stop 22 is attached to U-shaped member 24 which has legs 26 which extend next to the top 28 and bottom 30 interior wall of the opening 12 in the body member 10. Each leg 26 has a pair of holes 32 which match with like holes in the top 28 and bottom 30 on the body member 10. The prongs 42 of shackle 38 of padlock 36 passes through the holes 32 in the legs 26 and the top 28 and bottom 30 wall of the body member 10 to removably secure the head portions 54 within the body member 10 with the first 20 and second 22 stops within a recess or notch 58 in the head portion 54 of the clamping screws 50, and by so doing rotation of the clamping screws 50 is prevented.

In operation, the motor 44 is placed in its operating position and the clamping screws 50 are fully tightened so that the foot bearing pads 52 of the screws 50 are in tight engagement with the transom board 46. Next, the channel-like, body member 10 is passed over the head portions 54 of the clamping screws 50 while the shanks 56 of the screws 50 extend through slot 18 in body member 10. In so doing, care must be taken to be sure that a recess or notch 58 in head portion 54 of clamping screw 50 is aligned such that it will receive first stop 20. Thereafter, second stop 22 is passed into opening of body member 10. Again, care must be taken to be sure that second stop 22 passes into engagement with a recess or notch 58 in the head portion 54 of the other clamping screw 50. When the second stop 22 is placed in proper engagement with the recess 58, holes 32 in U-shaped member 24 are in alignment with the holes 34 in the top 28 and bottom 30 wall of the body member 10. Next the prongs 42 of the removable shackle 38 are passed through the holes 34 in the top 28 and bottom 30 walls of the body member 10 and the holes 32 in the legs 26 of U-shaped member 24. The tumbler portion 40 of the padlock 36 is placed on the shackle 38 and locked in place. While care must be taken to make sure the stops 20,22 are engaged with the recesses 58 in the head portions 54 of the screws 50, the device has a fail safe feature in that unless there is such proper engagement between the stops 20,22 and recesses 58, the holes 34 in the body member 10 and the holes 32 in the U-shaped member 24 will not be aligned and it will not be possible to pass the prongs 42 of the shackle 38 of the padlock 36 through such holes. When the device is properly installed it can be seen that the stops 20,22 are fixed in place and prevent rotation of the clamping screws 50 and removal of the motor 44 from the transom 46 of the boat.

It has been found that it is desirable to make the device from corrosion resistant, hardened material. It has also been found that a device having the following dimensions has performed satisfactorily in use:

Channel-like, body member 10: 7 inches long; $1\frac{3}{4}$ inches $\times$ $1\frac{3}{4}$ inches size of opening 12; 1/16 inch thickness; $\frac{5}{8}$ inch width of slot 18.

Clamping screws 50: $1\frac{5}{8}$ inch diameter of head portion; $2\frac{1}{4}$ inches center to center distance between screws.

Stops 20,22: $\frac{5}{8}$ inches in diameter.

It should be noted that the above dimensions are by way of example and not by way of limitation and that the device can be made in different sizes to fit a given set of conditions. It should also be noted that variations in the shape and configuration of various parts, such as, the body member, clamping screws, head portions of the clamping screws, stops and locking device are possible within the spirit of this invention.

I claim:

1. An anti-theft device in combination with outboard motor clamping screws for locking an outboard motor to a transom board, motor stand and the like, comprising:

(a) an elongated body member having a longitudinally extending opening which is closed at one end and open at the other end for closely receiving the head portions of said clamping screws which clamp the outboard motor in place, (b) said body member having a slot in one of its sides to receive the shank of said clamping screws, (c) said head portion of said clamping screws having a plurality of recesses therein, (d) a first stop within said body member adjacent said closed end of said opening and shaped to closely fit within one of said recesses of one of said head portions, (e) a second stop within said body member adjacent said open end of said opening and shaped to fit within one of said recesses of another of said head portions, and (f) locking means adjacent said open end of said opening including a padlock which passes through openings in said body member to removably secure said head portions of said clamping screws within said body member and in contact with said first and second stops to prevent rotation of said clamping screws.

2. The anti-theft device of claim 1 further comprising said first stop is fixedly attached within said body member.

3. The anti-theft device of claim 2 further comprising said second stop is fixedly attached to a U-shaped member which extends within said body member and includes a pair of openings in each of its legs to allow said padlock to extend through said pair of openings.

4. The anti-theft device of claim 3 further comprising said first and second stops having a cylindrical shape and said recesses shaped to receive a portion of said cylindrical shape.

* * * * *